US009924774B2

(12) United States Patent
Kim et al.

(10) Patent No.: US 9,924,774 B2
(45) Date of Patent: Mar. 27, 2018

(54) FRENCH ARTIFICIAL NAIL

(71) Applicant: JC KOREA CORP., Gyeonggi-do (KR)

(72) Inventors: Dong Sung Kim, Gyeonggi-do (KR); Hyun Surk Kim, Gyeonggi-do (KR); Kyung Sik Choi, Gyeonggi-do (KR); Ju Young Park, Gyeonggi-do (KR); Jeong Rim Choi, Gyeonggi-do (KR); Bo Mi Kim, Seoul (KR)

(73) Assignee: KMC EXIM CORP., Port Washington, NY (US)

( * ) Notice: Subject to any disclaimer, the term of this patent is extended or adjusted under 35 U.S.C. 154(b) by 71 days.

(21) Appl. No.: 14/634,229

(22) Filed: Feb. 27, 2015

(65) Prior Publication Data

US 2016/0249724 A1 Sep. 1, 2016
US 2017/0224084 A9 Aug. 10, 2017

(30) Foreign Application Priority Data

Apr. 11, 2014 (KR) ..... 10-2014-0043411

(51) Int. Cl.
*A45D 29/00* (2006.01)
*A45D 31/00* (2006.01)

(52) U.S. Cl.
CPC ..... *A45D 31/00* (2013.01); *A45D 2031/005* (2013.01)

(58) Field of Classification Search
CPC ..... A45D 31/00
IPC ..... A45D 31/00
See application file for complete search history.

(56) References Cited

U.S. PATENT DOCUMENTS

2007/0084478 A1* 4/2007 Tucker ..... A44C 15/008 132/73
2009/0241976 A1* 10/2009 Chang ..... A45D 31/00 132/200
2014/0123993 A1* 5/2014 Chang ..... A45D 31/00 132/73
2016/0029767 A1* 2/2016 Han ..... A45D 29/001 132/73

FOREIGN PATENT DOCUMENTS

KR 101108138 1/2012

* cited by examiner

*Primary Examiner* — Rachel Steitz
(74) *Attorney, Agent, or Firm* — Duane Morris LLP; J. Rodman Steele, Jr.; Gregory M. Lefkowitz

(57) ABSTRACT

Disclosed is a French artificial nail including an artificial nail body and a French part. The artificial nail body includes a cuticle edge facing the root of a fingernail and a free edge extending towards the tip of the fingernail and is curved downward toward both lateral sides thereof to form a curved surface. The French part is formed on the upper surface of the free edge of the artificial nail body. The artificial nail body is attached to a user's fingernail or toenail through glue and has a lower modulus than the French part. This flexibility of the artificial nail body prevents the formation of bubbles, the incidence of pain and the occurrence of pop-off resulting from glue shrinkage, contributing to an improvement in the wearability and reliability of the final product.

12 Claims, 2 Drawing Sheets

FRENCH ARTIFICIAL NAIL

CROSS-REFERENCE TO RELATED APPLICATIONS

This application claims priority under 35 U.S.C. § 119 to Korean Patent Application No. 10-2014-0043411 filed on Apr. 11, 2014 in the Korean Intellectual Property Office, the disclosure of which is incorporated herein by reference in its entirety.

BACKGROUND OF THE INVENTION

1. Field of the Invention

The present invention relates to a French artificial nail, and more particularly to a French artificial nail that can be protected from glue shrinkage and provides improved convenience for a user.

2. Description of the Related Art

Generally, when a user intends to improve the shapes of the user's fingernail, the user applies manicure to the fingernail to obtain a desired design. This work is called "nail art". However, the spreading of a solution, such as manicure, on fingernails for nail art is not only cumbersome and laborious but also requires much time to dry the solution.

Particularly, French nail art is a kind of nail art in which colors are printed on the tips of fingernails. For French nail art, manicures should be applied to uniform areas of fingernails and should be uniformly and equally applied along the end lines (smile lines) of fingernails located at the sides of nail beds. This work is difficult for unskilled persons to perform. Although skilled users can directly perform French nail art on their fingernails, the shapes of the fingernails after French nail art may be non-uniform depending on whether the users are left-handed or right-handed.

Many efforts to solve such problems have been made. For example, people visit professional shops, such as nail shops, and request nail art to improve the shapes of their fingernails. In this case, however, service expenses should be paid to French nail art experts whenever users receive the service, imposing an economic burden on the users.

In view of this situation, artificial nails with French designs formed thereon are currently produced and readily available to ordinary people (see, for example, Korean Patent Registration No. 10-1108138).

Conventional French artificial nails use glue for attachment to users' fingernails. The glue tends to shrink during subsequent curing. This glue shrinkage causes the formation of fine bubbles or pain to the users. As a result, the French artificial nails lose their aesthetic appearance and the users feel inconvenienced.

Impacts may be applied to the bubbled portions of the glue in use. In this case, defects such as cracks are likely to occur in the bubbled portions, resulting in peeling off of the French artificial nails ("pop-off").

SUMMARY OF THE INVENTION

The present invention has been made in an effort to solve the above problems, and it is an object of the present invention to provide a French artificial nail that can be protected from glue shrinkage and provides improved convenience for a user.

An embodiment of the present invention provides a French artificial nail including: an artificial nail body including a cuticle edge facing the root of a fingernail and a free edge extending towards the tip of the fingernail, and curved downward toward both lateral sides thereof to form a curved surface; and a French part formed on the upper surface of the free edge of the artificial nail body.

In the French artificial nail, the artificial nail body may be made of a flexible material having a lower modulus than that of the French part.

In the French artificial nail, the flexible material may include a resin and a softener, and the softener may include a solvent dissolving the resin, a plasticizer or a mixture thereof.

In the French artificial nail, the artificial nail body may have a modules of 4,000 to 9,999 $Kg/cm^2$.

In the French artificial nail, the artificial nail body may include a first fitting portion having a curved cross section formed at the end of the cuticle edge and second fitting portions, each of which is formed at the end of the corresponding lateral side and has a curved cross section.

In the French artificial nail, the first fitting portion may be integrally connected to the second fitting portions.

In the French artificial nail, the French part may be made of a rigid material having a higher modulus than that of the artificial nail body.

In the French artificial nail, the French part may have a modulus of 10,000 to 30,000 $Kg/cm^2$.

In the French artificial nail, the French part may include a resin and a curing agent and, together with the artificial nail body, may be formed by double injection molding or vacuum molding.

In the French artificial nail, the French part may include a gradation area with the same thickness embedded in the artificial nail body along the end thereof facing the cuticle edge.

In the French artificial nail, the gradation area may have a width of 0.1 to 6.0 mm in the lengthwise direction.

In the French artificial nail, the upper surface of the gradation area may lie at the same level as the upper surface of the artificial nail body.

In the French artificial nail, the artificial nail body may gradually decrease in thickness from the free edge to the cuticle edge and may gradually decrease in thickness from the central portion to both lateral sides.

The features and advantages of the present invention will become more apparent from the detailed description set forth below with reference to the appended drawings.

Prior to the detailed description of the invention, it should be understood that the terms and words used in the specification and claims are not to be construed as having common and dictionary meanings, but are construed as having meanings and concepts corresponding to the spirit of the invention in view of the principle that the inventor can define properly the concept of the terms and words in order to describe his/her invention with the best method.

The artificial nail body, which is attached to a user's fingernail or toenail through glue, has a lower modulus than the French part. This flexibility of the artificial nail body prevents the formation of bubbles, the incidence of pain and the occurrence of pop-off resulting from glue shrinkage, contributing to an improvement in the wearability and reliability of the final product.

In addition, a gradual shift from the color of the French part to the color of the artificial nail body can be observed in the gradation area. This color shift creates an aesthetic feeling. Therefore, the French artificial nail can effectively satisfy a user's aesthetic sense.

Furthermore, the first fitting portion and the second fitting portions of the artificial nail body 110 are designed to prevent the overflow of glue and the occurrence of a clearance. This design is effective in solving the problem that hairs or foreign matter may adhere to the French artificial nail.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
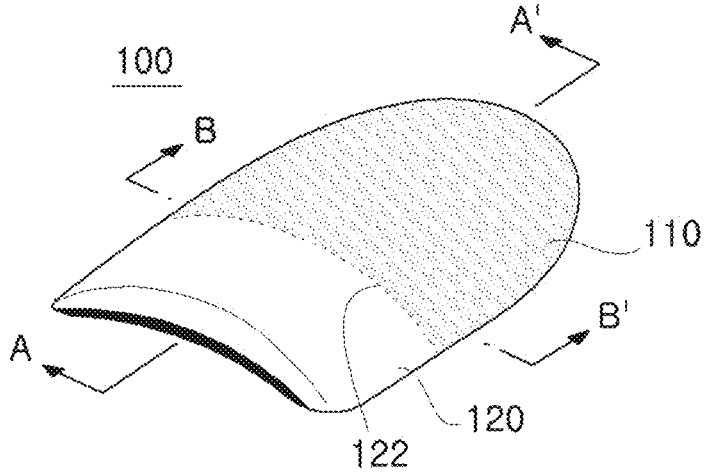
FIG. 1 is a perspective view of a French artificial nail according to an embodiment of the present invention.

The objects, certain advantages, and novel features of the present invention will become more apparent from the following detailed description and preferred embodiments when taken in conjunction with the accompanying drawings. It should be noted that, wherever possible, the same elements are denoted by the same reference numerals even though they are depicted in different drawings. Although the terms first, second, etc. may be used herein to describe various elements, these elements should not be limited by these terms. These terms are only used to distinguish one element from another. In the description of the present invention, certain detailed explanations of related art are omitted when it is deemed that they may unnecessarily obscure the essence of the invention.

Figure 2:
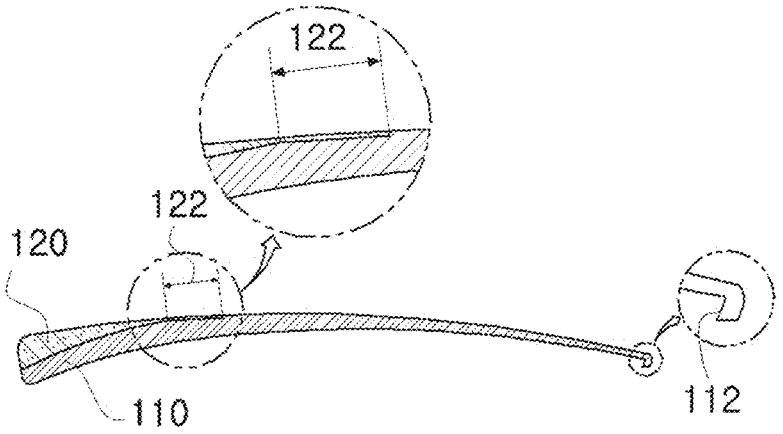
FIG. 2 is a cross-sectional view taken along line A-A' of FIG. 1.
Figure 3:
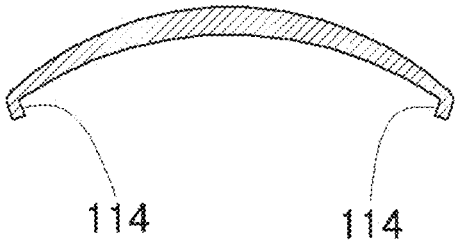
FIG. 3 is a cross-sectional view taken along line B-B' of FIG. 1.
Figure 4:
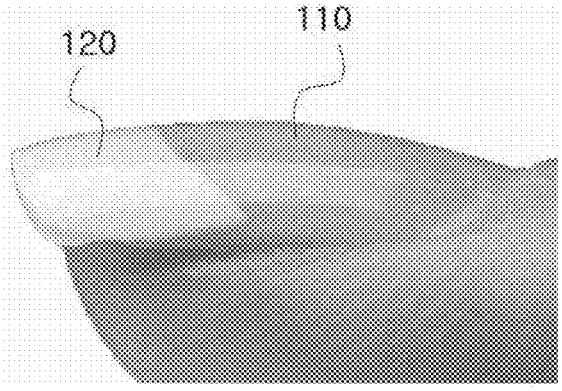
FIG. 4 shows an example of a French artificial nail according to an embodiment of the present invention.

Preferred embodiments of the present invention will now be described in detail with reference to the accompanying drawings. FIG. 1 is a perspective view of a French artificial nail according to an embodiment of the present invention, FIG. 2 is a cross-sectional view taken along line AA' of FIG. 1, FIG. 3 is a cross-sectional view taken along line B-B' of FIG. 1, and FIG. 4 shows an example of a French artificial nail according to an embodiment of the present invention.

The French artificial nail 100 includes an artificial nail body 110 including a cuticle edge facing the root of a fingernail and the free edge extending towards the tip of the fingernail and curved downward toward both lateral sides thereof to form a curved surface, and a French part 120 formed on the upper surface of the free edge of the artificial nail body 110.

Specific examples of materials for the artificial nail body 110 include polystyrene (PS), acrylonitrile-butadiene-styrene (ABS) copolymers, styrene-butadiene-styrene (SBS) block copolymers, ethylene-vinyl acetate (EVA) copolymers, PE, PP, PVC, TPU, polyamide, polyester, acrylic polymers, and silicone resins. Combinations of two or more of the above materials may also be used to form the artificial nail body 110. Such combinations may be copolymers and blends.

The artificial nail body 110 has a lower modulus than the French part 120. For example, the artificial nail body 110 may have a modulus of 4,000 to 9,999 $Kg/cm^2$, as measured by the ASTM D790 test method. This flexibility may be imparted to the artificial nail body 110 by the use of a softener. The kind and concentration of the softener may be suitably selected.

The softener may include a solvent dissolving the constituent resin of the artificial nail body 110, a plasticizer, or a mixture thereof. The solvent may be suitably selected depending on the kind of the resin, for example, an acrylic resin. The plasticizer may be an organic compound but is not necessarily limited thereto. The plasticizer may be suitably selected depending on the kind of the resin, for example, an acrylic resin. Preferably, the plasticizer is selected from those highly compatible with the resins, for example, an acrylic resin, and capable of reducing the hardness of the resins, for example, an acrylic resin. More preferably, the plasticizer is selected from those that generate very small amounts of hazardous substances, such as endocrine disruptors.

As illustrated in FIG. 2, the artificial nail body 110, together with the French part 120, may be formed into the shape of a fingernail by double injection molding or vacuum molding. It should be understood that a synthetic resin other than the resins described above and a process other than injection molding and vacuum molding may also be used to form the artificial nail body 110 into the shape of a fingernail.

The thickness of the artificial nail body 110 at the free edge facing the tip of the fingernail accounts for 20 to 50% of the sum of the thicknesses of the artificial nail body 110 and the French part 120, as illustrated in FIG. 2. The artificial nail body 110 has a structure in which the thickness gradually decreases from the free edge facing the tip of the fingernail to the cuticle edge facing the root of the fingernail and gradually decreases from the central portion to both lateral sides. This structure is illustrated in FIGS. 2 and 3.

The artificial nail body 110 includes a first fitting portion 112 having a curved cross section formed at the end of the cuticle edge facing the root of the fingernail, as illustrated in FIG. 2, and second fitting portions 114, each of which is formed at the end of the corresponding lateral side and has a curved cross section, as illustrated in FIG. 3.

Glue is spread on the lower surface of the French artificial nail 100 to attach the French artificial nail 100 to the fingernail or toenail of a user. The first fitting portion 112 and the second fitting portions 114 prevent overflow of the glue out of the French artificial nail 100 and the occurrence of a clearance between the French artificial nail 100 and the fingernail or toenail. The first fitting portion 112 may be formed separately from the second fitting portions 114. Alternatively, the first fitting portion 112 may be integrally connected to the second fitting portions 114.

The French part 120 formed on the upper surface of the free edge of the artificial nail body 110 has various colors or designs. The French part 120 has a higher modulus than the artificial nail body 110 to protect the French artificial nail 100 from shrinkage and external impact.

Specific examples of materials for the French part 120 include polystyrene (PS), acrylonitrile-butadiene-styrene (ABS) copolymers, styrene-butadiene-styrene (SBS) block copolymers, ethylene-vinyl acetate (EVA) copolymers, PE, PP, PVC, TPU, polyamide, polyester, acrylic polymers, silicone resins, polycarbonate (PC), and styrene-acrylonitrile (SAN). Combinations of two or more of the above materials may also be used to form the French part 120. Such combinations may be copolymers and blends.

The French part 120 has a higher modulus than the artificial nail body 110. For example, the French part 120 may have a modulus of 10,000 to 30,000 $Kg/cm^2$, as measured by the ASTM D790 test method. The modulus of the French part 120 is higher than that of the artificial nail body 110. For this rigidity, the French part 120 may optionally contain a curing agent. The French part 120, together with the artificial nail body 110, may be formed by a suitable molding process, such as double injection molding or vacuum molding. The kind of the curing agent may be suitably selected from those highly compatible with the above resins and capable of enhancing the hardness of the resins.

The thickness of the French part 120 at the free edge accounts for 50 to 80% of the sum of the thicknesses of the artificial nail body 110 and the French part 120. The French part 120 is formed such that the thickness gradually decreases from the free edge facing the tip of the fingernail toward the root of the fingernail. The French part 120 includes a gradation area 122 with the same thickness formed at the end thereof facing the root of the fingernail.

As illustrated in FIG. 2, the gradation area 122 has a predetermined width, for example, a width of 0.1 to 6.0 mm, in the lengthwise direction and is embedded with a predetermined thickness in the artificial nail body 110 along the end thereof. Thus, the upper surface of the gradation area 122 is connected to the upper surface of the artificial nail body 110 at the same level without deviation and a gradual shift in color between the French part 120 and the artificial nail body 110 can be effectively obtained.

As is apparent from the above description, a gradual shift from the color of the French part 120 to the color of the artificial nail body 110 can be observed in the gradation area 122. This color shift creates an aesthetic feeling. Therefore, the French artificial 100 nail can effectively satisfy a user's aesthetic sense.

In addition, the artificial nail body 110, which is attached to a user's fingernail or toenail through glue, is made flexible. This flexibility of the artificial nail body 110 prevents the formation of bubbles, the incidence of pain and the occurrence of pop-off resulting from glue shrinkage, contributing to an improvement in the wearability and reliability of the final product.

Furthermore, the first fitting portion 112 and the second fitting portions 114 of the artificial nail body 110 are designed to prevent the overflow of glue and the occurrence of a clearance. This design is effective in solving the problem that hairs or foreign matter may adhere to the French artificial nail 110.

It should be noted that the spirit of the present invention has been specifically described with reference to the preferred embodiments and the foregoing embodiments are merely illustrative and are not intended to limit the spirit of the present invention.

Those skilled in the art will appreciate that the present invention may be embodied in various forms without departing from the spirit of the invention.

What is claimed is:

1. A French artificial nail comprising:

an artificial nail body comprising a cuticle edge facing the root of a fingernail and a free edge extending towards the tip of the fingernail, and curved downward toward both lateral sides thereof to form a curved surface; and a French part formed on an upper surface of the free edge of the artificial nail body, wherein the artificial nail body comprises a flexible material having a lower modulus than that of the French part;

wherein the artificial nail body comprises a first fitting portion having a curved cross section formed at an end of the cuticle edge and second fitting portions, each of which is formed at an end of the corresponding lateral side and has a curved cross section, and the first fitting portion and the second fitting portions of the artificial nail body comprise bent edges of the artificial nail body, wherein the artificial nail body has a modulus of 4,000 to 9,999 $Kg/cm^2$;

wherein the French part has a modulus of 10,000 to 30,000 $Kg/cm^2$.

2. The French artificial nail according to claim 1, wherein the flexible material comprises a resin and a softener, and the softener comprises a solvent dissolving the resin, a plasticizer or a mixture thereof.

3. The French artificial nail according to claim 2, wherein the French part comprises a rigid material having a higher modulus than that of the artificial nail body.

4. The French artificial nail according to claim 3, wherein the French part comprises a curing agent.

5. The French artificial nail according to claim 1, wherein the first fitting portion is integrally connected to the second fitting portions.

6. The French artificial nail according to claim 1, wherein the French part comprises a rigid material having a higher modulus than that of the artificial nail body.

7. The French artificial nail according to claim 6, wherein the French part comprises a resin and a curing agent and, together with the artificial nail body, is formed by double injection molding or vacuum molding.

8. The French artificial nail according to claim 1, wherein the French part comprises a gradation area with the same thickness embedded in the artificial nail body along the end thereof facing the cuticle edge.

9. The French artificial nail according to claim 8, wherein the gradation area has a width of 0.1 to 6.0 mm in the lengthwise direction.

10. The French artificial nail according to claim 8, wherein an upper surface of the gradation area lies at the same level as the upper surface of the artificial nail body.

11. The French artificial nail according to claim 1, wherein the artificial nail body gradually decreases in thickness from the free edge to the cuticle edge and gradually decreases in thickness from the central portion to both lateral sides.

12. The French artificial nail according to claim 1, wherein the first fitting portion and the second fitting portions of the artificial nail body are configured to prevent overflow of glue when the French artificial nail is applied to a nail of a wearer.

* * * * *